United States Patent [19]

Hunter

[11] Patent Number: 4,836,450

[45] Date of Patent: Jun. 6, 1989

[54] SPRINKLER UNIT WITH ALTERNATING STREAM INTERRUPTOR

[76] Inventor: Edwin J. Hunter, 5551 Codorniz Rd., Rancho Santa Fe, Calif. 92067

[21] Appl. No.: 187,965

[22] Filed: Apr. 29, 1988

[51] Int. Cl.[4] ..... B05B 3/04

[52] U.S. Cl. ..... 239/232; 239/242; 239/507

[58] Field of Search ..... 239/97, 231, 232, 241, 239/242, 505, 507, 512, 222.11, 222.13

[56] References Cited

U.S. PATENT DOCUMENTS

| | | | |
|---|---|---|---|
| 3,026,044 | 3/1962 | Kennedy | 239/97 |
| 3,727,842 | 4/1973 | Ertsgaard et al. | 239/232 |
| 4,398,666 | 8/1983 | Hunter | 239/231 |
| 4,624,412 | 11/1986 | Hunter | 239/206 |
| 4,648,558 | 3/1987 | Rabitsch | 239/512 |

FOREIGN PATENT DOCUMENTS

| | | | |
|---|---|---|---|
| 196877 | 4/1923 | United Kingdom | 239/241 |

*Primary Examiner*—Andres Kashnikow
*Assistant Examiner*—Karen B. Merritt
*Attorney, Agent, or Firm*—Baker, Maxham, Jester & Meador

[57] ABSTRACT

A reversible sprinkler unit includes a stream interruptor that includes a finger that moves into the stream for interrupting it on one direction of rotation of the nozzle and moves out of the stream on the other direction of rotation of the nozzle.

20 Claims, 1 Drawing Sheet

SPRINKLER UNIT WITH ALTERNATING STREAM INTERRUPTOR

BACKGROUND OF THE INVENTION

The present invention relates to sprinkler unit and pertains particularly to stream interruptor for enhancing the distribution of the water stream.

The artificial distribution of water through irrigation systems is in wide use throughout the world today. There are many irrigation systems utilized, with each having its benefits and drawbacks.

One of the most widely used systems, particularly where water is valuable, is the sprinkler unit wherein a plurality of nozzles are distributed about an area for distributing water over the surface of the land area. Such system are widely used for lawns, golf courses and playing fields and many crops.

The ideal sprinkler irrigation system would achieve a uniform distribution of water over a maximum area with a minimum number of nozzles. This approach presents a major problem since the optimum reach of a sprinkler unit is inconsistent with optimum distribution. Optimum reach of a sprinkler unit is achieved by maintaining a coherent or homogeneous water stream. For a rotating stream sprinkler unit having a coherent stream, the majority of the water would be distributed in a circular path at the outermost reach of the stream, forming a circle surrounding the sprinkler unit. In order to cover the area inside the circle toward the center of axis rotation, it is necessary to interrupt the stream to cause deflection of a portion of the stream over the inner area. Many attempts have been made in the past to provide an optimum mechanism for achieving a proper distribution of water over the area. While many of these attempts have proven to be somewhat effective, they have not been entirely satisfactory.

Accordingly, it is desirable that an optimum mechanism be available for interrupting a stream of water from a sprinkler unit to provide optimum water coverage.

SUMMARY AND OBJECTS OF THE INVENTION

Accordingly, it is a primary object of the present invention to provide a sprinkler unit having means for achieving an optimum uniform coverage.

In accordance with the primary aspect of the present invention, a sprinkler unit comprises an alternately rotating nozzle, and means extending into the stream in one direction of rotation of the nozzle, and moved out of the stream in the other direction of rotation of the nozzle for intermittently interrupting the stream issuing therefrom.

BRIEF DESCRIPTION OF THE DRAWING

The above and other objects and advantages of the present invention will become apparent from the following description when read in conjunction with the drawings wherein.

DETAIL DESCRIPTION OF A PREFERRED EMBODIMENT

Figure 1:
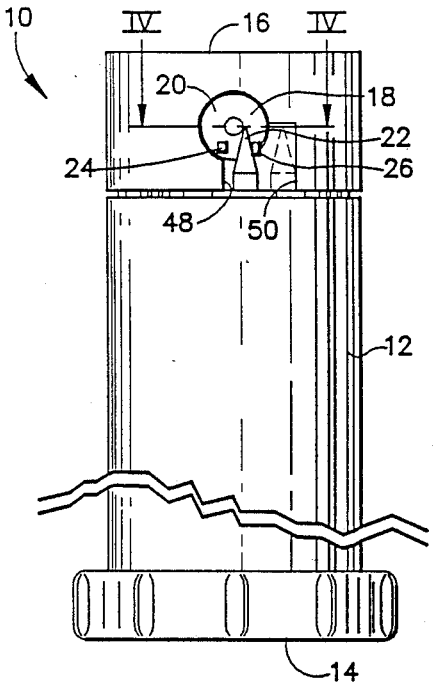
FIG. 1 is in a front elevation view of a typical reversible sprinkler unit showing a preferred embodiment of the invention.

Referring to FIG. 1 of the drawings, there is illustrated a sprinkler unit, such as that disclosed in my prior U.S. Pat. No. 4,718,605, granted Jan. , 1988, entitled "REVERSIBLE GEAR OSCILLATING SPRINKLER" and my U.S. Pat. No. 3,107,056, issued Oct. 15, 1963 entitled "SPRINKLER", both of which are incorporated herein by reference. The sprinkler unit is of a reversible or alternating type wherein the sprinkler unit is reversible, and the nozzle can be adjusted to sweep back and forth across a selected area to be covered.

In the aforementioned patents, which are incorporated herein by reference as though fully set forth, and as illustrated in FIG. 1, there is disclosed a sprinkler unit 10, which includes a fixed housing 12, having an inlet end 14 and an outlet end on which is mounted a rotary generally cylindrical head, in which is mounted a nozzle 18 having an orifice 20, from which a coherent water stream issues for maximum reach. The housing 12 provides with means (not shown) on the inlet end for attachment to a source of pressurized water, such as a riser or the like.

The housing 12 is of a generally tubular cylindrical type having a central through bore, forming a chamber within the housing wherein there is mounted a drive assembly (not show), including a turbine and gear driving mechanism, such as disclosed in my aforementioned prior patents. The gear driving mechanism includes a reversing mechanism, such that a tripping stop or level can be adjustably positioned so that it reverses the gear drive. The reversing gear drives the head so that the sprinkler nozzle sweeps back and forth across an area of a selected angle determined by the setting of the stops for the reversing mechanism.

In order to optimum or approach optimum coverage of the watered area, a stream interruptor in the form of a tapered pin or finger 22 is provided, which intermittently enters the water stream from nozzle 20 for intermittently interrupting the water as the sprinkler unit sweeps over the covered area. In the present invention, the interruptor finger 22 is mounted on a semi-circular slide member that is mounted to slide within a recess along the inner surface of the upper end of the housing. The finger 22 shifts into the stream to interrupt the stream in one direction of rotation, and shifts out of the streams in the opposite direction of rotation for non-interruption thereof.

A pair of stops or shoulders 24 and 26 on the face of the nozzle 18 engages the finger 22 and positions and carriers it in the appropriate direction with the nozzle. A generally rectangular recess formed in the front of head 16, between shoulders 48 and 50, enbales the finger 22 to be moved away from the opening in the head, which receives the nozzle to enable changing the nozzle. The shoulders 24 and 26 are formed on the nozzles and are designed to coincide with the diameter of the stream issuing from the nozzle. Thus, the illustrated unit has a preferred position for the finger depending on the nozzle selected.

Figure 2:
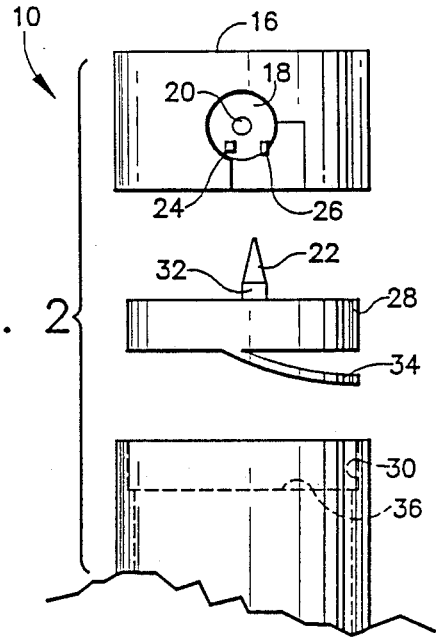
FIG. 2 is a front elevation exploded view of the interruptor assembly and nozzle of FIG. 1.

Referring to FIG. 2, the interruptor assembly comprises a semi-circular or partial band 28, which is sized and configured to slideably fit within a radial or annular recess 30 within the upper end of housing 12. A spring finger 34 extends downward from the lower edge of the band 28, and engages an annular shoulder 36 in the housing 12 for biasing the band to an uppermost position against the lower edge of upper member or head 16.

Figure 5:
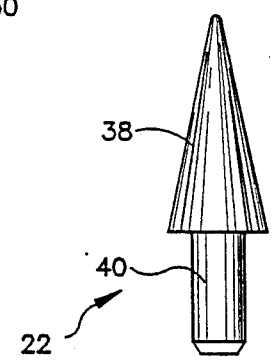
FIG. 5 is a side elevation view of a first embodiment of the interruptor pin.
Figure 6:
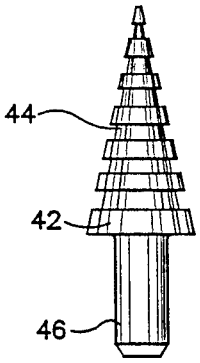
FIG. 6 is a side elevation view of a second embodiment of the interruptor pin.

Mounted approximate the center of the arc of the band is an interruptor finger in the form of a finger or the like 22 that extends upward and has a generally conical configuration. The conical configuration may be define by a continuous smooth surface or by an interrupted surface having annular grooves therearound, as illustrated for example in FIGS. 5 and 6. The finger includes the tappered or conical finger portion, and a shank portion which extends into a bore in the band member.

Figure 3:
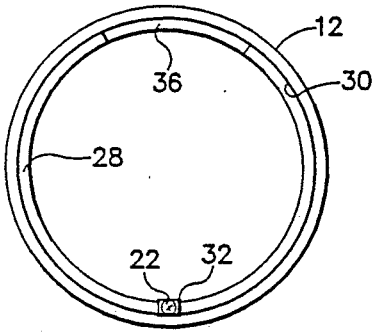
FIG. 3 is a top view on line IV—IV of FIG. 1.

Referring to FIG. 3, the band or slide 28 is shown as a part circle resting in the recess 30, with a portion of the shoulder 36 shown in the gap between the ends of the semi-circular band 28. The finger 22 is shown mounted in and extending upward from mount 32 on the slide or band 28.

The slide 28 is preferably formed of a suitable plastic material having some spring and a greater diameter than the housing. When the slide is put in place in the housing, it expands outward into engagement with the inner wall surface or recess 30 of the housing.

Figure 4:
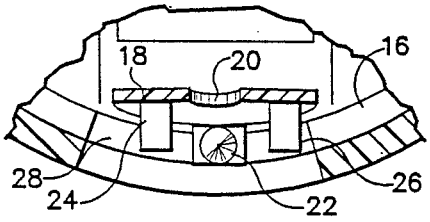
FIG. 4 is an enlarged section view taken on line IV—IV of FIG. 1.

Referring to FIG. 4, details of the finger and engaging shoulders 22 and 24 are illustrated. The positioning of the finger 22 shows that it is to one side of the orifice 20 when the head 16 is rotating in the clockwise direction. It is also apparent that shoulder 24 will engage and hold the finger 22 directly in front of the orifice 20 (stream interrupting position) when the head 16 is rotating in the counter-clockwise direction. Any number or size and shape of interruptor fingers or pins can be provided, with the finger having a different degree of interruption, depending upon the surface form and configuration. In addition, the size of the finger as well its length and as how far it extends into the stream can affect the amount of degree of interruption. For, example a larger diameter finger or one extending farther into the stream will provide a greater degree of interruption of the stream.

In the illustrated embodiment, the slide or band 28 is mounted within the housing 12, such that the finger 22 extends to a position that will overlap a lower portion of the nozzle and extend into the stream on one direction of rotation. A pair of stop or abutment members 24 and 26, one to each side of the nozzle or orifice, is provided for engaging the finger and carrying the band with the nozzle as it traverses its area of coverage. The abutments are positioned such that in one direction of rotation the finger is positioned in the stream of flow from the nozzle. Whereas, in the opposite direction of rotation, the finger is to one side of the stream.

With this arrangement, the stream is interrupted in one direction of rotation, and is totally un-interrupted in the opposite direction of rotation. This provides a simple effective and inexpensive intermittent interruptor for the nozzle.

While I have illustrated and described my invention by means of specific embodiments, it is to be understood that numerous changes and modifications may be made therein without departing from the spirit and scope of the invention as defined in appended claims.

I claim:

1. An oscillating sprinkler unit having intermittent interrupting means, comprising:

a housing having an inlet end and an outlet end and means for attachment of the inlet to a source of water under pressure;

a nozzle rotatably mounted at said outlet for distributing a stream of water outward from said housing;

means in said housing for rotating said nozzle in alternate directions about its axis; and stream interrupting means moveable with said nozzle in said alternate directions and operative in one direction of rotation of said nozzle for interrupting said stream and moveable with said nozzle and inoperative in the opposite direction for non-interruption of said stream.

2. A sprinkler unit according to claim 2 wherein said stream interrupting means comprises a finger; and means for positioning said finger in said stream in said one direction of rotation.

3. A sprinkler unit according to claim 2 wherein:

said finger is mounted on a rotary slide mounted in the upper end of said housing.

4. A sprinkler unit according to claim 2 wherein:

said means for positioning said finger in said stream comprises a pair of opposing shoulders carried by said nozzle.

5. A sprinkler unit according to claim 1 wherein:

said finger has a generally conical configuration tapering toward said nozzle.

6. A sprinkler unit according to claim 1 wherein :

said finger has generally a conical configuration tapering toward said nozzle and a plurality of groves formed in the surface and extending around the axis thereof.

7. An oscillating sprinkler unit having intermittent stream interrupting means comprising:

a housing having an inlet end and an outlet end and means for attachment of the inlet end to a source of water under pressure;

a nozzle rotatably mounted at said outlet for distributing a stream of water outward from said housing;

means in said housing for rotating said nozzle in alternate directions about its axis; and steam interrupting means moveable with said nozzle;

stream interrupting means moveable with said nozzle and operative in one direction of rotation of said nozzle for interrupting said stream and inoperative in the opposite direction comprising a finger mounted on a semi-circular rotary slide mounted in a recess in the upper end of said housing; and said nozzle is mounted in rotary cylindrical head, said slide has an upper edge and a lower edge and biasing means on said lower edge for biasing said slide into engagement with a lower edge of said rotary head.

8. A sprinkler unit according to claim 7 wherein:

said means for positioning said finger in said stream comprises a pair of opposing shoulders carried by said head.

9. A sprinkler unit according to claim 8 wherein:

said finger has a generally conical configuration tapering toward said nozzle.

10. A sprinkler unit according to claim 8 wherein:

said finger has a generally conical configuration tapering toward said nozzle and a plurality of grooves formed in the surface and extending around the axis thereof.

11. An oscillating sprinkler unit having means for intermittently interrupting a stream therefrom, comprising:

an elongated having a longitudinal axis, an inlet end and an outlet end and being attachable at the inlet end to a source of water under pressure;

a nozzle mounted for rotation about said axis at said outlet end for distributing a stream of water outward from said housing;

drive means in said housing for rotating said nozzle in alternate directions about said axis;

stream interrupting means comprising a finger; and means moveable with said nozzle for moving said finger therewith in said alternate directions and operative in one direction of rotation of said nozzle for positioning said finger in said streams for interrupting said stream and operative in the opposite direction for positioning said finger outside said stream for non-interruption thereof.

12. A sprinkler unit according to claim 11 wherein:

said finger is mounted on a rotary slide mounted in the upper end of said housing.

13. A sprinkler unit according to claim 12 wherein:

said means for positioning said finger in said stream comprises a pair of opposed shoulders carried by said nozzle.

14. A sprinkler unit according to claim 13 wherein:

said finger has a generally conical configuration tapering toward said nozzle.

15. A sprinkler unit according to claim 11 wherein:

aid finger has a generally conical configuration tapering toward said nozzle and a plurality of grooves formed in the surface and extending around the axis thereof.

16. A sprinkler unit having means for intermittently interrupting a stream therefrom, comprising:

an elongated housing having a longitudinal axis, an inlet end and an outlet end and being attachable at the inlet end to a source of water under pressure;

a nozzle mounted for rotation about said axis at said outlet end for distributing a stream of water outward from said housing;

drive means in said housing for rotating said nozzle in alternate directions about said axis;

stream interrupting means comprising a finger having a generally conical configuration toward said nozzle and a plurality of grooves formed in the surface and extending around the axis thereof;

means moveable with said nozzle and operative in one direction of rotation of said nozzle for positioning said finger in said stream for interrupting said stream and operative in the opposite direction for positioning said finger outside said stream for non-interruption thereof;

said finger is mounted on a rotary slide mounted in the upper end of said housing; and said slide has an upper edge and a lower edge and biasing means on said lower edge for biasing said slide into engagement with a lower edge of said rotary head.

17. An oscillating sprinkler unit having intermittent interrupting means, comprising:

an elongated cylindrical housing having an inlet end and an outlet end and means for attachment of the inlet end to a source of water under pressure;

a nozzle rotatably at said outlet end of said housing for distributing a stream of water outward from said housing;

drive means in said housing for rotating said nozzle in alternate directions about its axis; and stream interrupting means comprising a finger moveable with said nozzle in said alternate directions and means operative in one direction of rotation of said nozzle for positioning said finger for interrupting said stream and operative in the opposite direction for positioning said finger outside said stream for non-interruption thereof.

18. An oscillating sprinkler unit having intermittent interrupting means, comprising:

an elongated cylindrical housing having an inlet end and an outlet end and means for attachment of the inlet end to a source of water under pressure;

a rotary head including a nozzle rotatably mounted at said outlet end of said housing for distributing a stream of water outward from said housing;

drive means in said housing for rotating said nozzle in alternate directions about its axis;

stream interrupting means comprising a finger moveable with said nozzle and means operative in one direction of rotation of said nozzle for positioning said finger in said stream for interrupting said stream and operative in the opposite direction for positioning said finger outside stream;

said finger mounted on a rotary slide mounted in the upper end of said housing, said slide has an upper edge and a lower edge and biasing means on side lower edge for biasing said slide into engagement with a lower edge of said rotary head; and said means for positioning said finger in said stream comprises a shoulder carried by said nozzle.

19. A sprinkler unit according to claim 18 wherein:

said finger has a generally conical configuration tapering toward said nozzle.

20. A sprinkler unit according to claim 19 wherein:

said finger has a generally conical configuration tapering toward said nozzle and a plurality of grooves formed in the surface and extending around the axis thereof.

* * * * *